United States Patent [19]

Cousty

[11] Patent Number: 4,678,372

[45] Date of Patent: Jul. 7, 1987

[54] RAISING METHOD AND DEVICE, IN PARTICULAR FOR AN OIL EXPLOITING PLATFORM

[75] Inventor: Jean Pierre Cousty, Bezons, France

[73] Assignee: Technip Geoproduction, Paris La Defence, France

[21] Appl. No.: 894,120

[22] Filed: Aug. 7, 1986

[30] Foreign Application Priority Data

May 2, 1986 [FR] France ..... 86 06402

[51] Int. Cl.[4] ..... E02B 17/08

[52] U.S. Cl. ..... 405/196; 405/197; 405/204; 52/126.1; 52/741

[58] Field of Search ..... 405/195–200, 405/204, 224, 230, 216; 254/93 R, 387; 52/170, 514, 126.1, 741; 114/264, 265

[56] References Cited

U.S. PATENT DOCUMENTS

| | | | |
|---|---|---|---|
| 2,946,557 | 7/1960 | Suderow | 405/197 X |
| 3,401,917 | 9/1968 | Bradbury | 405/197 X |
| 3,699,688 | 10/1972 | Estes | 405/197 |
| 4,002,038 | 1/1977 | Phares et al. | 405/199 |
| 4,040,265 | 8/1977 | Hellerman et al. | 405/196 |
| 4,126,011 | 11/1978 | Lamy et al. | 405/196 |
| 4,427,319 | 1/1984 | Mayr | 405/196 |

*Primary Examiner*—Cornelius J. Husar
*Assistant Examiner*—Nancy J. Stodola
*Attorney, Agent, or Firm*—Wenderoth, Lind & Ponack

[57] ABSTRACT

This method for raising a platform comprising a platform proper or deck carried by legs bearing on the sea bed comprises: fixing on each of the legs (2) of the platform a raising device (4) constituting a reinforcing device whose regions of fixing to the legs (2) are located on each side of a region of the leg to be cut; cutting the leg so as to divide it into a lower portion (2*a*) and an upper portion (2*b*); when all the legs have been cut, actuating the raising devices associated with each of the legs so as to raise the platform to an extent corresponding to the desired raising while controlling the attitude of the platform, and fixing between the ends of the portions (2*a*) and (2*b*) of each leg a heightening element (5) which once more interconnects the two portions of the leg, and removing the raising devices.

12 Claims, 20 Drawing Figures

FIG. 3
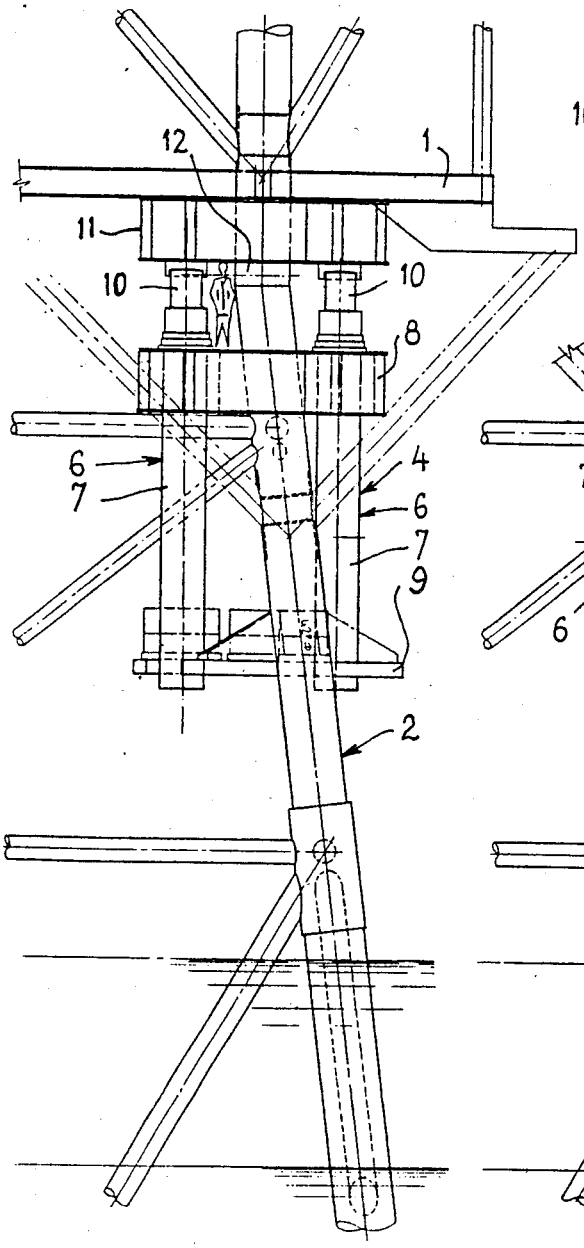
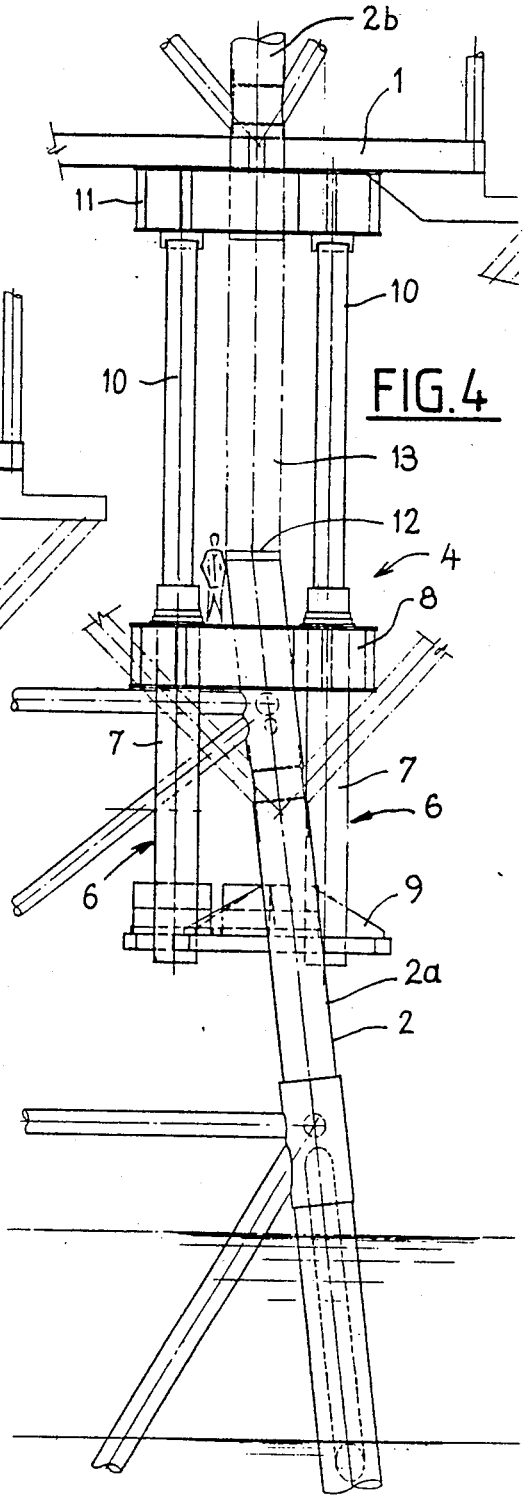
FIG. 4

RAISING METHOD AND DEVICE, IN PARTICULAR FOR AN OIL EXPLOITING PLATFORM

The present invention relates to oil platforms and more particularly to the raising of offshore oil exploiting platforms.

It has been found that in some regions of the world, and in particular in the North sea, some oil sites on which fixed oil exploiting platforms are installed, have a tendency to sink owing in particular to the instability of certain layers of the subsoil brought on by the cavities left in the subsoil by the operations involving the pumping of large quantities of oil out of the geological pockets which contain it.

The sinking of the site results in a subsidence of the sea bed on which the pylons of the oil exploiting platforms bear so that their height above the sea level decreases dangerously and there is a risk of rendering these platforms dangerous within a few years for the exploiting personnel, especially in bad weather.

An object of the invention is to provide a method and a device for raising an oil platform to a sufficient height to enable the platform to be used, notwithstanding the sinking of the sea bed on which it is placed, until the exhaustion of the oil-bearing strata it exploits.

The invention therefore provides a method for raising an offshore oil exploiting platform comprising a platform proper or deck carried by legs which bear on the sea bed, said method comprising:

(a) fixing on each of the legs of the platform a raising device constituting a reinforcing device, whose fixing regions of the legs are located on each side of a region of the leg to be cut, and putting the raising device under load;

(b) making in said region of the leg a cut so as to divide it into a lower portion which bears on the sea bed and an upper portion connected to the deck;

(c) when all the legs of the platform are cut, actuating the raising devices associated with each of the legs so as to displace the platform through a travel corresponding to the desired raising while controlling the attitude of the platform, and fixing between the ends of the portions of each leg a heightening element which once again interconnects the two portions of the leg, and (d) removing the raising means.

In the accompanying drawings which are given solely by way of example:

FIG. 3 is a partial elevational view to an enlarged scale of an oil platform leg on which is mounted a raising device according to the invention before the raising;

FIG. 4 is a view corresponding to that of FIG. 3 showing the raising device according to the invention in the position at the end of the raising;

Figure 1:
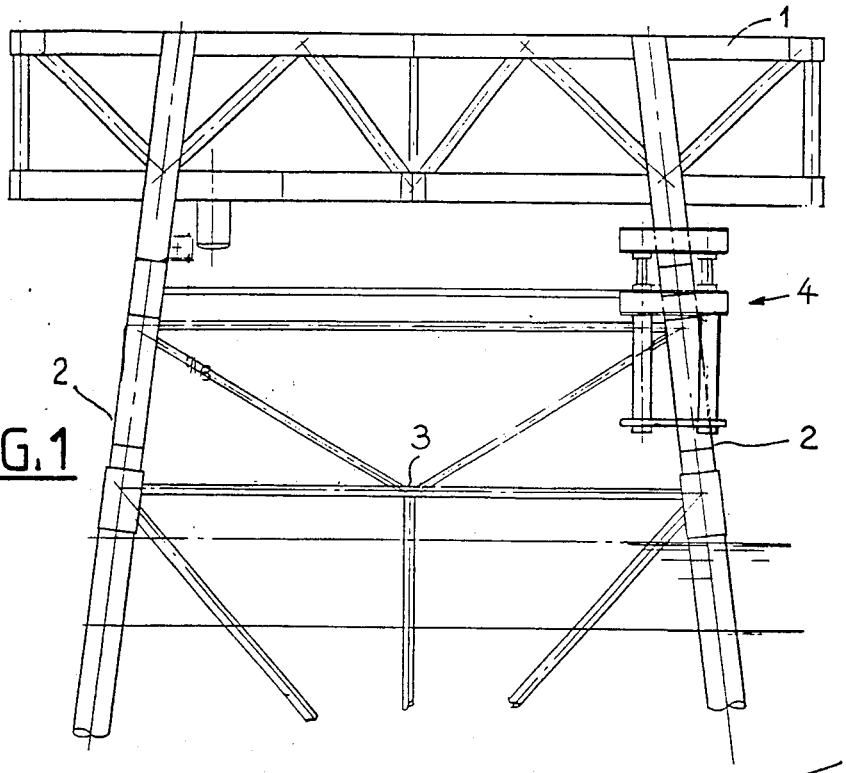
FIG. 1 is a diagrammatic elevational view of an oil platform before it is raised by means of the method of the invention.

The platform diagrammatically shown in FIG. 1 comprises a platform proper or deck 1 supported by tubular legs 2 interconnected by a lattice 3 of metal girders and bearing on the sea bed. Fixed to each of the legs 2 in a manner which will be described hereinafter is a raising device 4 constituted by an assembly of hydraulic jacks. The raising devices 4 are adapted, after the cutting of each of the legs in a region intermediate between the fixing regions of each of the raising devices on the leg 2 with which they are associated, to cooperate to ensure the upward displacement of the deck 1 through a suitable distance.

Figure 2:
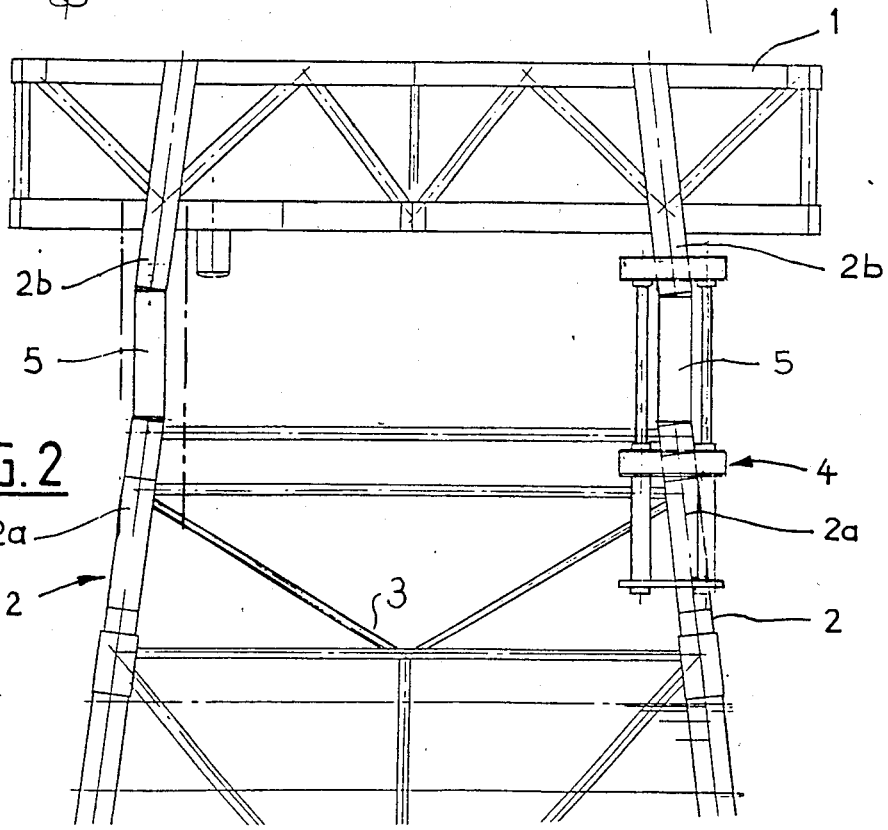
FIG. 2 is a view similar to FIG. 1 of the platform after it has been raised.

FIG. 2 shows the platform of FIG. 1 after it has been raised. It can be seen that the raising devices 4 are in their extended position.

Interposed between the leg portions 2*a* and 2*b* resulting from the cutting of each of the legs 2, the ends of these portions being separated by a gap resulting from the raising operation, are heightening tubes 5 ensuring the reconstitution of the continuity of each of the legs.

There is shown to an enlarged scale in FIG. 3 a leg 2 of a platform on which is placed in position a raising device 4 constituted by two hydraulic jacks 6 whose cylinders 7 are interconnected by supports 8 and 9 welded to the leg 2 in regions located below the region of the leg which must be cut. The rods 10 of the jacks 6 bear through a head 11 welded below the lower part of the deck 1.

In FIG. 3, the jacks 7 of the raising device 4 are shown in their retracted position. Between the first support 8 which assembles the upper ends of the cylinder 7 and the bearing head 11 of the rods 10 of the jacks there has been shown in dot-dash lines a region 12 in which the leg must be cut. Before proceeding to the cutting, the jacks 6 of the device 4 are put under load which then performs the function of a reinforcing device by taking the load exerted by the weight of the deck on the corresponding leg.

In FIG. 4, the jacks 6 of the raising device 4 are shown in their extended position, the rods 10 of the jacks being in their outer position and having effected, through the bearing head 11 of their free ends, an upward displacement of the upper portion 2*b* of the leg 2, the lower portion 2*a* of the latter which bears on the sea bottom acting as a support through the supports 8 and 9 assembling the cylinders 7 of the jacks 6 when the raising effort is applied to the deck 1 by said jacks.

The travel of the jack rods 10 corresponds to the extent to which the platform is raised. This raising extent is represented by the gap 13 resulting from the relative displacement of the portions 2*a* and 2*b* of the leg 2 after the latter has been cut in the region 12.

Figure 7:
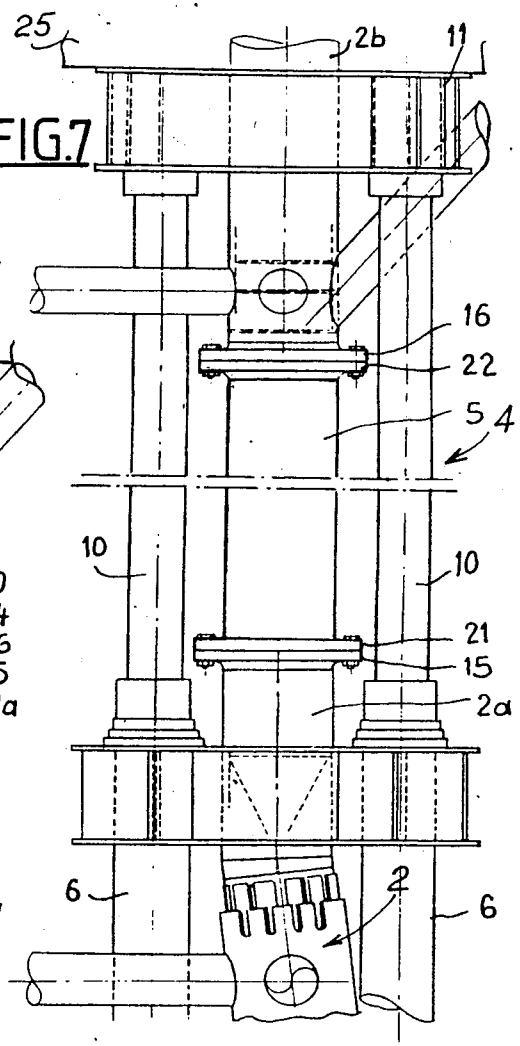
FIG. 7 is a view similar to FIGS. 5 and 6 showing the leg of the platform after raising.
Figure 6:
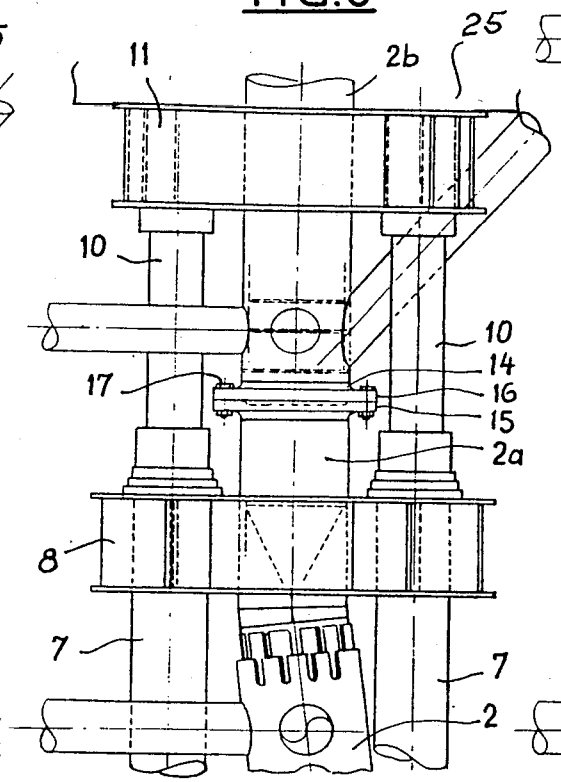
FIG. 6 is a view similar to FIG. 5 showing a second stage of the raising method according to the invention.
Figure 5:
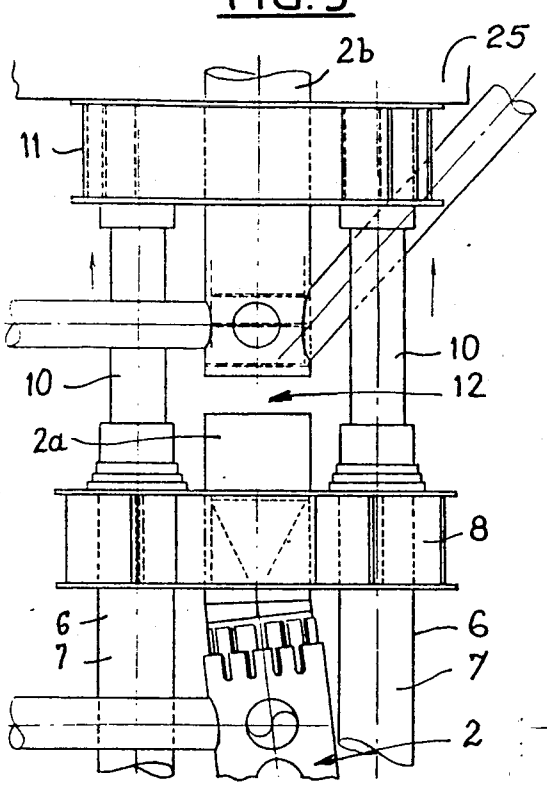
FIG. 5 is a partial view to an enlarged scale of an oil platform leg showing a first stage of the raising method according to the invention.
Figure 9:
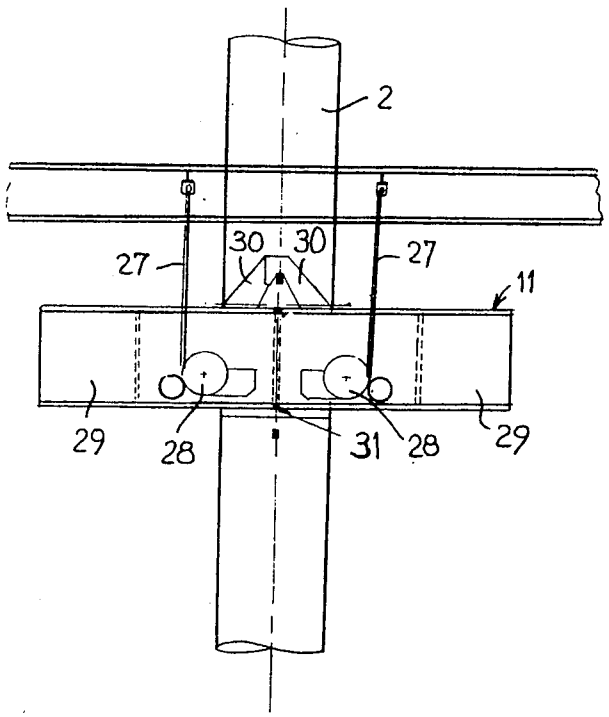
FIGS. 8 and 9 are diagrammatic elevational views of the stages for placing in position the head of the raising device around a platform leg.

Reference will now be made to FIGS. 5 to 7 in order to describe in more detail the various stages of the platform raising operation in respect of one of the legs of the platform.

FIG. 5 shows a first stage of the operation during which, after the positioning of the raising device 4 and the communication of pressure to the jacks 6 of the latter, there has been cut in the leg 2 a tube section in the region 12 and this section has been removed so that the lower leg portion 2 and upper leg portion 2*b* are now separated by a gap. The portions 2*a* and 2*b* are held in position by the raising device which thus constitutes in the initial stage of the operations a device for reinforcing the leg 2.

As shown in FIG. 6, a connecting unit 14 is inserted between the upper portion 2*a* and lower portion 2*b* of the leg 2, this unit being in two parts provided with end flanges 15, 16 interconnected by assembly bolts 17. Each of the parts 15, 16 of the unit 14 is welded to the end of the corresponding portion 2*a*, 2*b* of the leg 2. By this operation, the integrity of the leg 2 is reconstituted while rendering it separable and consequently ready to undergo the platform raising operation.

The two parts 15, 16 of the unit 14 are provided with complementary centering cones (not shown) for, on one hand, centering the flanges relative to each other and, on the other hand, supporting the lateral forces.

Such a technique permits proceeding in turn to the preparation of all the legs of the platform without compromising the stability of the latter, and, when all the legs have had a corresponding connecting unit 14 inserted therein, awaiting the suitable atmospheric conditions for proceeding to the raising proper, within a minimum period of time.

FIG. 7 is a view corresponding to FIGS. 6 and 5, in which it can be seen that the raising operation is finished. The rods 10 of the jacks 6 are in their extended position and have upwardly displaced the leg portion 2*b* relative to the portion 2*a* and a heightening tube 5 has been inserted in the gap between the ends of the portions 2*a* and 2*b* so as to reconstitute the integrity of the leg 2. The heightening element 20 comprises at its ends flanges 21, 22 which are connected with the respective flanges 15, 16 of the unit 14 in two parts which have been inserted instead of the tube section withdrawn by cutting operations in the course of the stages of operation shown in FIG. 6. The flanges 21, 22 are also provided with centering cones (not shown) complementary to the cones of the flanges 15 and 16 of the unit 14 with which they are adapted to cooperate.

The flanges 15 and 21 on one hand and 16 and 22 on the other are interconnected by assembly bolts similar to bolts 17.

The mounting of the raising device according to the invention on a platform leg will now be described.

This mounting is commenced by installing the bearing head 11 of the ends of the rods 10 of the jacks 6 against the lower part of the deck 1 surrounding the corresponding leg 2.

Figure 8:
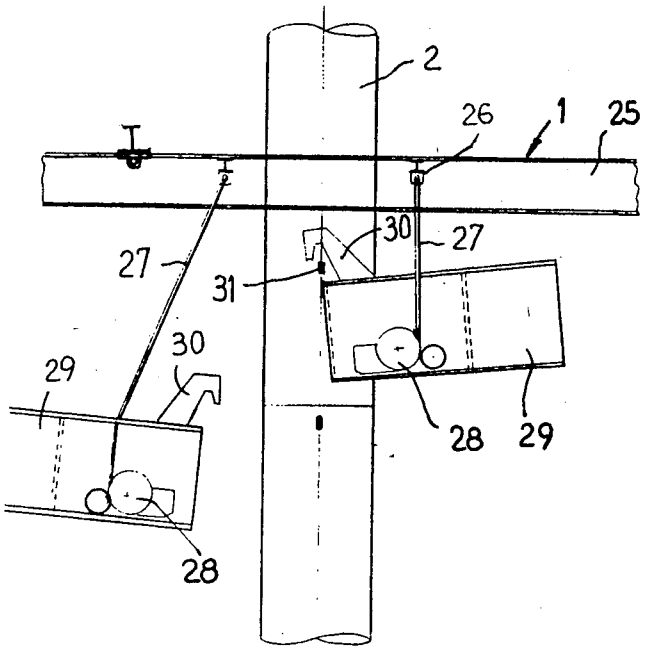
Figure 11:
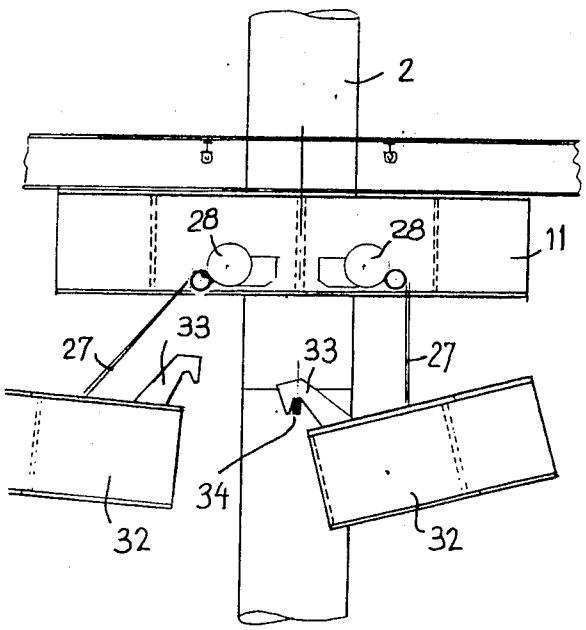
FIGS. 10 to 12 are views similar to FIGS. 8 and 9 showing the positioning of the supports of the raising device.

As shown in FIG. 8, the deck 1 comprises a lower floor 25 provided in the region surrounding the leg 2 with hooking means 26 for cables 27 each wound around a winch 28. Each winch 28 is disposed in a semi-girder or jaw 29 adapted to form the head 11 after assembly. Each of the jaws is made in the form of a mechanically assembled and welded sheet metal box structure and defines on the side thereof adapted to come into contact with the leg 2 a semi-cylindrical recess.

FIG. 8 shows the two jaws 29 adapted to constitute the head 11 respectively hooked to their suspension cable 27. Each of the jaws is provided with a hook 30 which is cooperative with a lug 31 provided on the leg 2. When the winches 28 located in each of the jaws 29 are actuated, these jaws are shifted upwardly until they assume positions in which they are in facing relation so that the edges of their semi-cylindrical recesses are in mutual contact and their hook 30 is engaged with the lug 31. The butt-welding of the jaws 29 can now be carried out in diametrically opposed regions 31.

Figure 10:
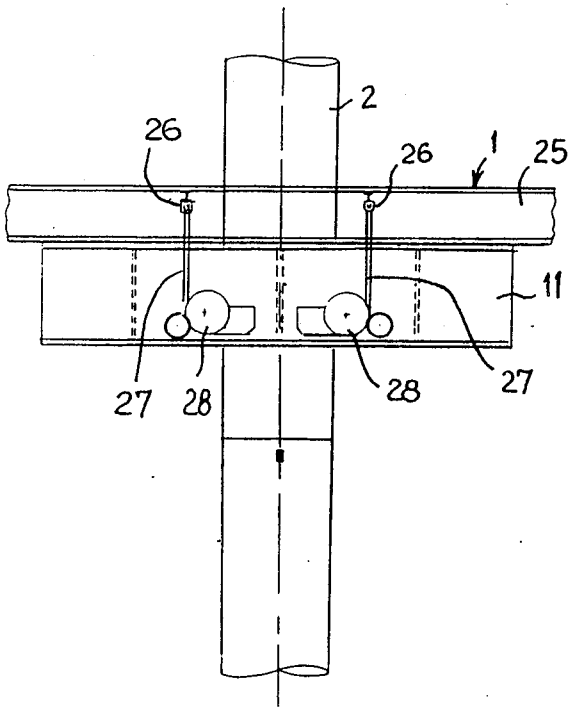

When the welding has finished, the head 11 formed by its two jaws welded together is still suspended by the cables 27. The hooks 30 are then cut away and the winches 28 are again actuated so as to move the head 11 along the leg 2 until it is applied against the floor 25 of the deck 1, as shown in FIG. 10.

When this operation has finished, the head 11 is fixed by welding it to the leg 2 and to the deck 25.

The cables 27 can now be released from the hooking elements 26 of the floor 25.

Figure 12:
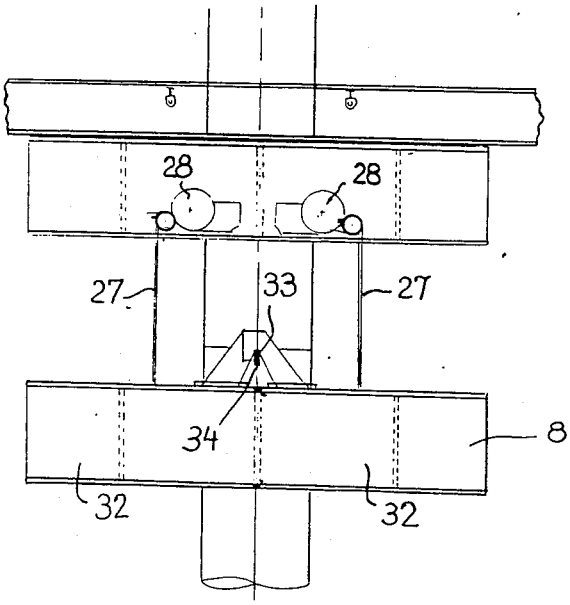

The winches 28 are thereafter used for placing in position the intermediate support 8 which is also formed by two semi-girders or jaws 32 in the form of a mechanically and welded assembly of a sheet metal box structure similar to that of the jaws of the head 11 and which also includes hooks 33 cooperative with a lug 34 provided on the leg 2 and disposed at a suitable distance below the lug 31 for placing the head 11 in position. This head then acts as a suspension element for the jaws 32 which are placed in position and butt-welded together and also welded to the leg 2 in the position shown in FIG. 12. When the welding operations have finished, the hooks 33 are cut off.

The lower support 9, which has merely to support the vertical forces due to its own weight, is made from sheet steel. It is much lighter than the head 11 and the intermediate support 8 so that it may be placed in position on the leg 2 by hoisting means conventionally used on a ship.

With reference again to FIG. 3, it can be seen that the head 11 is placed in position around a vertical portion of the leg 2 while the intermediate support 8, or first support, and the lower support 9, or second support, are fixed to an inclined portion of this leg.

Figure 15:
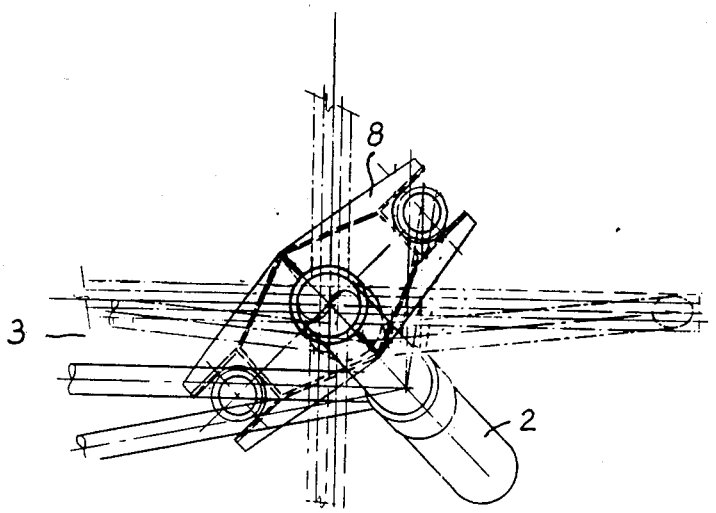
FIG. 15 is a partial plan view of the intermediate support of the raising device in position on a platform leg.

The position of the intermediate support 8 on the inclined portion of the leg 2 is shown in plan in FIG. 15 which also represents some of the girders of the lattice structure of metal girders 3 interconnecting the legs.

Figure 16:
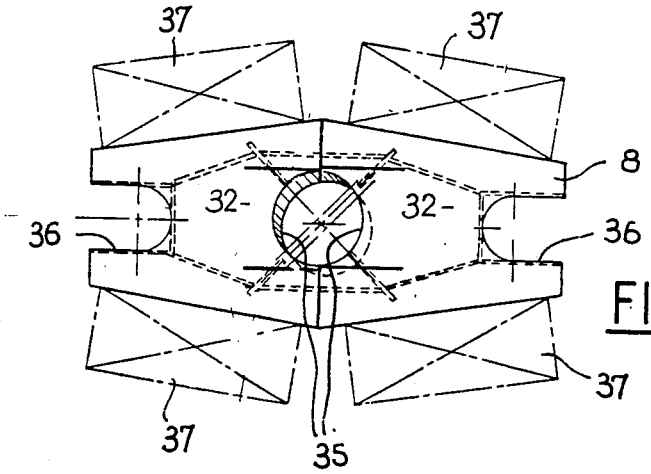
FIG. 16 is a plan view of the intermediate support of the raising device according to the invention.
Figure 17:
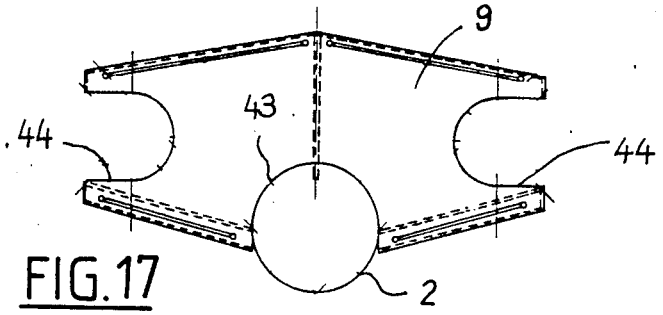
FIG. 17 is a plan view of the lower support of the raising device according to the invention.

The intermediate support 8 is shown more clearly in FIG. 16. This support comprises, as mentioned before, two jaws 32 whose facing sides which are welded together include semi-cylindrical recesses 35 together defining a passage for the leg 2, whose axis is parallel to the axis of the inclined portion of the leg on which the support 8 is mounted.

Each of the jaws 32 which constitute the support 8 includes a fork 36 adapted to receive the cylinder 7 of a corresponding jack 6.

The support 8 advantageously includes a main hydraulic control device, pumps supplying fluid under pressure to the jacks 6 and corresponding hydraulic connecting pipes (not shown). Hydraulic fluid tanks 37 shown in dot-dash lines in FIG. 15 are disposed on the sides of the support 8.

Figure 18:
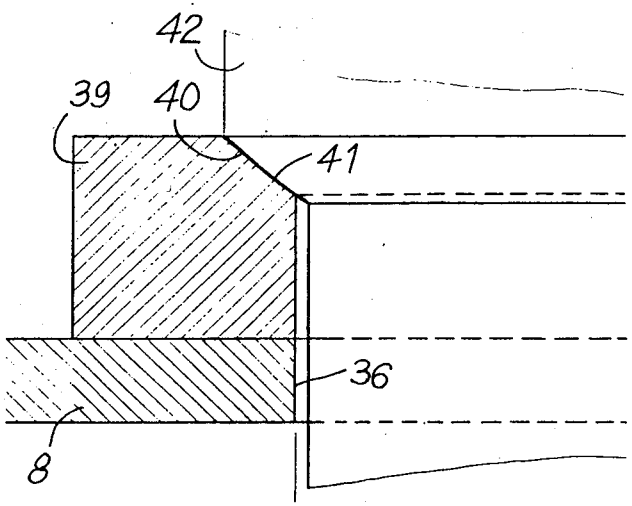
FIG. 18 is a sectional view of a detail of the intermediate support.

The cylinder 7 of a jack is placed in position in a fork 36 of the support 8, as shown in FIG. 18, by means of an annnular block 39 placed on the top of the fork 36 and including an annular seat 40 of spherical profile and of large diameter with which cooperates a bearing surface 41 of corresponding shape provided on a shoulder 42 of the outer surface of the cylinder 7 of the corresponding jack.

Such an arrangement permits taking up possible inaccuracies in the assembly of the jacks so as to ensure that these jacks exert a thrust in an exactly vertical direction.

The lower support 9, which is of lighter construction than the intermediate support 8, has a lateral semicircular recess 43 in which the leg 2 is engaged in a portion of its periphery.

The support 9 further comprises forks 44 for receiving the lower ends of the cylinders 7 of the jacks 6.

In the embodiment just described, each raising device has two jacks. However, it will be understood that for a platform of larger and heavier structure, it is also possible to provide raising devices having a larger number of jacks. In this case, the bearing head for the rods of the jacks and the intermediate and lower supports will be designed in a manner similar to the corresponding elements of the presently-described embodiment, but adapted to receive the desired number of jacks.

Figure 13:
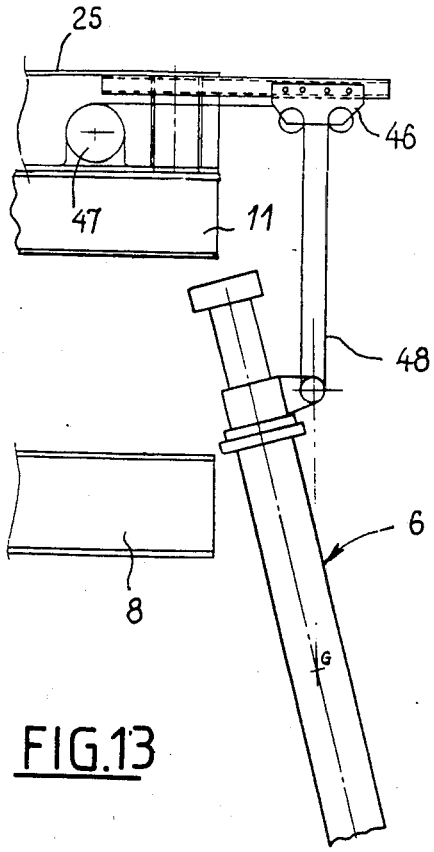
FIGS. 13 and 14 are diagrammatic views of the installation of the hydraulic jacks in the supports of the raising device.
Figure 14:
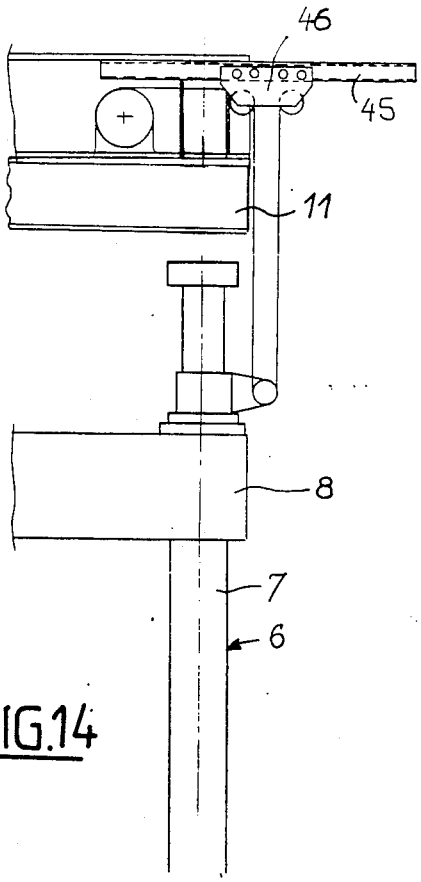

FIGS. 13 and 14 show the stage of handling a jack 6 for placing it in position in the supports 8 and 9 and under the head 11.

For this purpose, there is mounted in the deck 25 a rail 45 a part of which is in overhanging relation to the deck and in which is movably mounted a carriage 46 driven by an electric motor 47 and provided with means for suspending the jack 6 through a cable 48.

FIG. 13 shows the suspended jack 6 before it is placed in position and FIG. 14 shows the jack brought by the carriage 46 to the desired position below the head 11, the other end of the cylinder 7 of the jack 6 being engaged in the corresponding fork 36 of the intermediate support 8.

Figure 20:
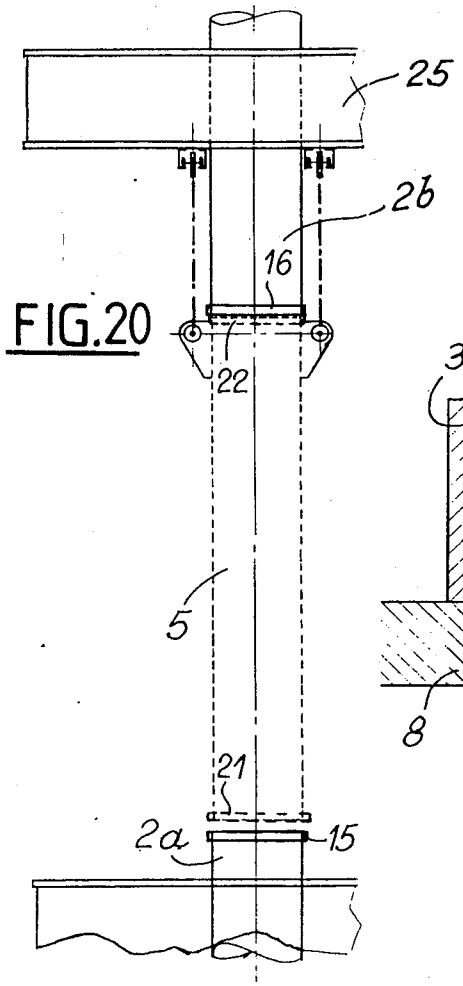
FIGS. 19 and 20 are diagrammatic elevational views showing the positioning of a heightening element constituting a spacer element after the raising of the platform.
Figure 19:
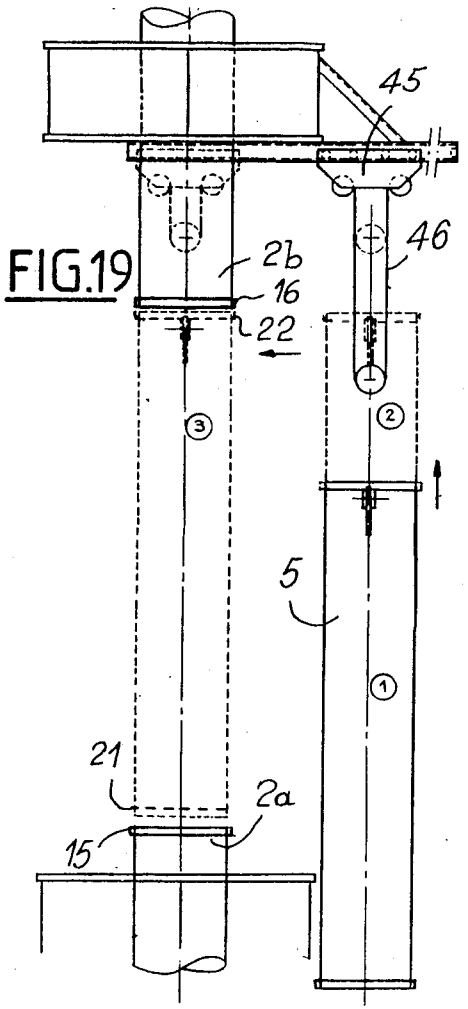

This handling device is also used for placing the heightening elements 5 in position when the raising operations have finished (FIGS. 19 and 20).

The raising operations are conducted by a central computer which receives at each moment information concerning the position of all the jacks associated with the legs of the platform and which processes, for the hydraulic control circuit of the suppy pumps of the jacks, control signals for accelerating or decelerating the rise of the rods of the corresponding jacks in accordance with the data concerning the required attitude of the platform to be respected.

The instantaneous position of each of the jacks is given for example by sensor systems of electromagnetic type incorporated in the jacks.

By means of the arrangement just described, it is possible to ensure under good conditions and within a few hours the raising and the consolidation in the raised position of a oil platform of very great weight. The jacks employed in the raising devices are jacks having a very long travel which may be as much as 6 meters.

In the embodiment just described, the ends of the jack rods bear against a head 11 fixed under the lower part of the deck. It is also possible to envisage an arrangement in which the ends of the jack rods bear directly against the lower wall of the deck by providing in the latter sufficient reinforcing elements for supporting the raising forces exerted by the jacks.

What is claimed is:

1. A method for raising in particular an offshore oil exploiting platform comprising legs bearing on the sea bed, and a deck carried by the legs, said method comprising the following steps:

(a) fixing on each of the legs a raising device forming a reinforcing device having regions of the fixing of the device to the respective leg which are located on each side of a region of the leg to be cut, and putting the raising device under load;

(b) effecting in said cutting region of the leg a cut so as to divide the leg into a lower portion which bears on the sea bed and an upper portion connected to the deck;

(c) when all the legs of the platform have been cut, actuating the raising devices associated with the respective legs so as to shift the platform to an extent corresponding to the desired raising while controlling the attitude of the platform, and fixing between the ends of the portions of each leg a heightening element which again interconnects the two portions of the leg, and (d) removing the raising devices.

2. A method according to claim 1, wherein the cut effected in each leg comprises cutting and withdrawing a section of said leg so as to form a gap between ends of the lower portion and upper portion of the leg.

3. A method according to claim 2, further comprising inserting in said gap formed by the removal of said leg section, a unit in two parts which are interconnected by detachable assembling means, welding each of the two parts of said unit respectively to one end of the corresponding portion of the leg so as to temporarily reconstitute the integrity of said leg, and removing the removable assembling means immediately before the actuation of the raising device.

4. A raising device for carrying out a method for raising in particular an offshore oil exploiting platform comprising legs bearing on the sea bed, and a deck carried by the legs, said method comprising the following steps:

(a) fixing on each of the legs a raising device forming a reinforcing device having regions of the fixing of the device to the respective leg which are located on each side of a region of the leg to be cut, and putting the raising device under load;

(b) effecting in said cutting region of the leg a cut so as to divide the leg into a lower portion which bears on the sea bed and an upper portion connected to the deck;

(c) when all the legs of the platform have been cut, actuating the raising devices associated with the respective legs so as to shift the platform to an extent corresponding to the desired raising while controlling the attitude of the platform, and fixing between the ends of the portions of each leg a heightening element which again interconnects the two portions of the leg, and (d) removing the raising devices, said device comprising, in association with the respective leg of the platform, at least a first support fixed to the leg below the region of the leg to be cut and at least two hydraulic jacks having cylinders engaged in said support and rods bearing against an under side of the deck of the platform.

5. A raising device according to claim 4, further comprising a second support fixed to the respective leg below the first support and in which are engaged lower ends of the cylinders of the jacks.

6. A raising device according to claim 4, further comprising a head fixed to the leg against the under side of the deck of the platform against which bear ends of the rods of the jacks.

7. A raising device according to claim 4, wherein said first support comprises two jaws each provided with a semi-cylindrical recess and assembled together and with the leg by welding, the semi-cylindrical recesses constituting a passage for the leg, and forks for receiving the cylinders of the jacks.

8. A raising device according to claim 7, comprising for each cylinder an annular block defining a seat having a spherical profile and a bearing surface of matching shape provided on a shoulder of the cylinder for cooperation with the seat defined by the annular block, the cylinder of each jack bearing against the corresponding fork of said first support through said annular block.

9. A raising device according to claim 6, wherein said head comprises two jaws which are assembled with each other and with the leg by welding and provided with semicylindrical recesses which together form a passage for said leg.

10. A raising device according to claim 9, comprising in each jaw of said head and, for each leg, hooking means connected to the deck, a winch having a cable having a free end connected to said hooking means for shifting the respective jack, said winches also constituting means for handling the jaws of the first support after said head has been fixed against the under side of the deck.

11. A raising device according to claim 4, wherein said jaws of the first support and said jaws of the head are provided with respective hooks carried by the respective leg for maintaining said jaws in position on the leg for the purpose of welding the jaws to each other and to the leg.

12. A raising device according to claim 5, wherein said second support comprises a semi-circular lateral recess in which the respective leg is engaged and forks for receiving the lower ends of the cylinders of the corresponding jacks.

* * * * *